US008277271B2

(12) United States Patent
Kato et al.

(10) Patent No.: US 8,277,271 B2
(45) Date of Patent: Oct. 2, 2012

(54) FUEL SUPPLY SYSTEM FOR BOAT AND OUTBOARD MOTOR

(75) Inventors: Masahiko Kato, Shizuoka (JP); Yoshiyuki Kadobayashi, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 349 days.

(21) Appl. No.: 12/473,291

(22) Filed: May 28, 2009

(65) Prior Publication Data

US 2009/0298365 A1 Dec. 3, 2009

(30) Foreign Application Priority Data

May 30, 2008 (JP) ..... 2008-142575

(51) Int. Cl.
*F02M 37/00* (2006.01)

(52) U.S. Cl. ..... 440/88 F

(58) Field of Classification Search ..... 123/468, 123/469, 470, 471, 472, 511, 514, 516; 440/88 F, 440/88 R See application file for complete search history.

(56) References Cited

U.S. PATENT DOCUMENTS 5,115,784 A * 5/1992 Mito et al. ..... 123/516
5,555,858 A * 9/1996 Katoh ..... 123/73 SC
5,829,402 A * 11/1998 Takahashi et al. ..... 123/184.24
5,896,835 A * 4/1999 Kato ..... 123/73 A
6,695,657 B2 * 2/2004 Hattori ..... 440/84

FOREIGN PATENT DOCUMENTS

JP 09-088623 A 3/1997
JP 2001-140720 A 5/2001

OTHER PUBLICATIONS

Kato et al.; "Fuel Supply System for Boat and Outboard Motor"; U.S. Appl. No. 12/473,290, filed May 28, 2009.
Kato et al.; "Fuel Supply System for Boat and Outboard Motor"; U.S. Appl. No. 12/473,293, filed May 28, 2009.
Kato et al.; "Fuel Supply System for Boat and Outboard Motor"; U.S. Appl. No. 12/473,294, filed May 28, 2009.

* cited by examiner

*Primary Examiner* — Daniel Venne
*Assistant Examiner* — Anthony Wiest
(74) *Attorney, Agent, or Firm* — Keating & Bennett, LLP

(57) ABSTRACT

A fuel supply system for a boat includes a vapor separator tank arranged to be connected to a fuel tank mounted on a hull of the boat and arranged to contain fuel therein, an injector arranged to supply fuel to an engine, a high-pressure fuel pump arranged to supply the fuel contained in the vapor separator tank to the injector, and a throttle body including a throttle valve arranged to adjust a flow rate of air supplied to the engine. The vapor separator tank is disposed adjacent to the throttle body. The fuel supply system minimizes deterioration in engine startability.

13 Claims, 16 Drawing Sheets

FUEL SUPPLY SYSTEM FOR BOAT AND OUTBOARD MOTOR

BACKGROUND OF THE INVENTION

1. Field of the Invention

The present invention relates to a fuel supply system for a boat and an outboard motor. Specifically, the present invention relates to a fuel supply system for a boat having a second fuel tank connected to a first fuel tank mounted on a hull and an outboard motor.

2. Description of the Related Art

Conventionally, a fuel supply system for a boat having a second fuel tank connected to a first fuel tank mounted on a hull is known (See JP A 2001-140720 and JP A Hei 9-88623, for example).

The fuel supply system for a boat described in JP A 2001-140720 and JP A Hei 9-88623 is a fuel supply system for a boat having an outboard motor. In examples disclosed in JP A 2001-140720 and JP A Hei 9-88623, fuel pumped from a fuel tank (first fuel tank) mounted on a hull is contained in a vapor separator tank (second fuel tank). The fuel contained in the vapor separator tank is supplied to a fuel injection device by a fuel supply pump. The vapor separator tank is disposed close to an engine.

However, in the examples disclosed in JP A 2001-140720 and JP A Hei 9-88623, since the vapor separator tank is disposed close to the engine, it is subject to heat radiated from the engine. Therefore, when the engine of a boat is stopped after a heavily-loaded operation, the fuel temperature in the vapor separator tank is increased by heat radiated from the heated engine. Accordingly, the fuel in the vapor separator tank easily becomes vapor (vaporized fuel) and then returns to the fuel tank mounted on the hull. In this case, fuel in the vapor separator tank decreases due to the vaporized fuel that is returned to the fuel tank mounted on the hull. Therefore, during a restart of the engine, it takes a long time to pump up fuel to the vapor separator tank from the fuel tank on the hull, which makes it difficult for the fuel supply pump to efficiently pump up fuel from the vapor separator tank to supply to the fuel injection device. This hampers smooth engine starting.

SUMMARY OF THE INVENTION

In order to overcome the problems described above, preferred embodiments of the present invention provide a fuel supply system for a boat and an outboard motor that minimizes deterioration in engine startability.

A fuel supply system for a boat according to a first preferred embodiment of the present invention includes a second fuel tank arranged to be connected to a first fuel tank mounted on a hull of a boat, the second fuel tank arranged to contain fuel therein; a fuel injection device arranged to supply fuel to an engine; a fuel supply pump arranged to supply the fuel contained in the second tank to the fuel injection device; and a throttle body including a throttle valve arranged to adjust a flow rate of air to the engine. The second fuel tank is disposed adjacent to the throttle body. Note that the word "adjacent to" means not only the case where the second fuel tank contacts with the throttle body but also the case where there is a gap between the second fuel tank and the throttle body or the case where there is another member between the second fuel tank and the throttle body.

In the fuel supply system for a boat according to the first preferred embodiment, as described above, the second fuel tank is disposed adjacent to the throttle body including the throttle valve arranged to adjust a flow rate of air to the engine.

Therefore, the second fuel tank receiving heat radiated from the engine can be cooled by the throttle body which has a relatively low temperature. More specifically, since air flows fastest in the throttle body, heat is rapidly absorbed by the fast flowing air or by the fuel vaporization. As a result, the throttle body becomes resistant to a rise in temperature. The second fuel tank receiving heat radiated from the engine can be cooled by the throttle body which has a relatively low temperature disposed adjacent to the second fuel tank. This minimizes an increase in the temperature in the second fuel tank, thereby minimizing the generation of vapor (vaporized fuel) in the second fuel tank. Therefore, it is possible to prevent vaporized fuel from returning to the first fuel tank mounted on the hull, thereby minimizing the fuel reduction in the second fuel tank. As a result, it becomes easy for the fuel supply pump to pump fuel up from the second fuel tank and supply fuel to the fuel injection device during a restart of the engine. Deterioration in startability of the engine can thereby be minimized.

In the fuel supply system for a boat according to the first preferred embodiment, the second fuel tank and the throttle body are preferably integral, or separate but disposed adjacent to each other.

In the fuel supply system for a boat according to the first preferred embodiment, the second fuel tank and the fuel supply pump are preferably spaced away from the engine. With this configuration, since the second fuel tank and the fuel supply pump are not directly attached to the engine, heat directly transmitted from the engine to the second fuel tank and the fuel supply pump can be minimized. Thus, a temperature increase in the second fuel tank and the fuel supply pump can be minimized, thereby minimizing the generation of vapor in the second fuel tank and the fuel supply pump.

Preferably, the fuel supply system for a boat according to the first preferred embodiment further includes a check valve arranged to allow the vaporized fuel in the second fuel tank to pass in a direction from the second fuel tank to the throttle body. With this configuration, when vaporized fuel collects in the second fuel tank, the pressure of the vaporized fuel opens the check valve to automatically release the vaporized fuel in the second fuel tank to the throttle body.

In the fuel supply system for a boat according to the first preferred embodiment, the fuel supply pump is preferably disposed outside and adjacent to the second fuel tank. With this configuration, a pipe arranged to connect the fuel supply pump and the second fuel tank can be shortened, thereby decreasing a heat receiving area that receives heat radiated from the engine. This minimizes the generation of vaporized fuel.

In this case, preferably, the second fuel tank is disposed below and adjacent to the throttle body and the fuel supply pump is disposed beside and adjacent to the second fuel tank. With this configuration, the throttle body, the second fuel tank, and the fuel supply pump can be arranged within a small space.

In the above configuration where the second fuel tank is disposed below the throttle body and the fuel supply pump is disposed beside the second fuel tank, preferably, the second fuel tank is placed on one side with respect to a vertical center line crossing a central axis of an air passage of the throttle body and the fuel supply pump is placed on the other side with respect to the vertical center line. With this configuration, the second fuel tank and the fuel supply pump can be arranged so that they sandwich the air passage of the throttle body. Thus, a unit defined by the throttle body, the second fuel tank, and the fuel supply pump can be made compact.

In the above configuration where the second fuel tank is disposed below the throttle body and the fuel supply pump is disposed beside the second fuel tank, preferably, the fuel supply pump includes a pump main portion having a fuel path, a rotary shaft arranged to drive the pump main portion, and a pump driving section arranged to rotate the rotary shaft, and the pump main portion is disposed below the throttle body and beside and adjacent to the second fuel tank. With this configuration, since the pump main portion is disposed beside and adjacent to the second fuel tank, a fuel pipe arranged to connect the pump main portion and the second fuel tank can be prevented from being lengthened.

In this case, preferably, the rotary shaft extends upward from the pump main portion and is positioned out of the air passage of the throttle body as seen from the top, and a bearing portion is preferably integral with the throttle body in the vicinity of the air passage of the throttle body to retain the rotary shaft to be rotatable. With this configuration, the rotary shaft can be extended upward via the bearing portion provided in the vicinity of the air passage of the throttle body. This allows the pump main portion to be positioned in the vicinity of the air passage of the throttle body, thereby bringing the pump main portion closer to the second fuel tank. Accordingly, the fuel pipe arranged to connect the pump main portion and the second fuel tank can be further prevented from being lengthened.

In the above configuration where the fuel supply pump is disposed outside of and adjacent to the second fuel tank, the fuel injection device is preferably configured to be disposed adjacent to the throttle body and to inject fuel in the throttle body. With this configuration, all of the fuel supply pump, the second fuel tank, and the fuel injection device can be disposed adjacent to the vicinity of the throttle body. This allows the fuel system to be arranged within a small space, thereby shortening pipes arranged to connect the second fuel tank, the fuel supply pump, and the fuel injection device with each other. This decreases a heat-receiving area that receives heat radiated from the engine, thereby minimizing the generation of vaporized fuel. Also, since the fuel system is disposed within a small space, the fuel supply system for a boat can be made compact.

In this case, preferably, the engine includes a plurality of cylinders and further includes a plurality of intake pipes, first ends of which are connected to the throttle body and second ends of which are respectively connected to the plurality of cylinders, and a single fuel injection device is provided for all of the plurality of intake pipes. With this configuration, the single fuel injection device can supply a fuel-air mixture to the plurality of cylinders.

In the fuel supply system for a boat according to the first preferred embodiment, the second fuel tank, the fuel injection device, and the fuel supply pump are preferably supported by the throttle body. With this configuration, the fuel system including the second fuel tank, the fuel supply pump, and the fuel injection device is not directly supported by the heated engine. Accordingly, differing from the case where the fuel system is supported by the engine via supporting members, a temperature rise of the fuel system caused by heat directly transmitted from the engine can be minimized.

In the fuel supply system for a boat according to the first preferred embodiment, at least one of a throttle opening sensor arranged to detect the opening degree of the throttle valve, an intake air temperature sensor arranged to detect air temperature in the throttle body, an intake air pressure sensor arranged to detect air pressure in the throttle body, and an Idle Speed Control unit may be disposed adjacent to the throttle body.

An outboard motor according to a second preferred embodiment of the present invention includes an engine; a second fuel tank arranged to be connected to a first fuel tank mounted on a hull, the second fuel tank arranged to contain fuel therein; a fuel injection device arranged to supply fuel to the engine; a fuel supply pump arranged to supply the fuel contained in the second tank to the fuel injection device; and a throttle body including a throttle valve arranged to adjust a flow rate of air to the engine, wherein the second fuel tank is disposed adjacent to the throttle body.

In the outboard motor according to the second preferred embodiment, as described above, the second fuel tank is disposed adjacent to the throttle body including the throttle valve arranged to adjust a flow rate of air to the engine. Therefore, the second fuel tank receiving heat radiated from the engine can be cooled by the throttle body which has a relatively low temperature. More specifically, air flows fastest in the throttle body, rapidly drawing heat from the throttle body. As a result, the throttle body becomes resistant to a rise in temperature. The second fuel tank receiving heat radiated from the engine can be cooled by the throttle body which has a relatively low temperature disposed adjacent to the second fuel tank. This minimizes an increase in the temperature in the second fuel tank, thereby minimizing the generation of vapor (vaporized fuel) in the second fuel tank. Therefore, it is possible to prevent vaporized fuel from returning to the first fuel tank mounted on the hull, thereby minimizing the fuel reduction in the second fuel tank. As a result, it becomes easy for the fuel supply pump to pump fuel up from the second fuel tank and supply fuel to the fuel injection device during a restart of the engine. Deterioration in startability of the engine can thereby be minimized.

Other features, elements, steps, characteristics and advantages of the present invention will become more apparent from the following detailed description of preferred embodiments of the present invention with reference to the attached drawings.

BRIEF DESCRIPTION OF THE PREFERRED EMBODIMENTS

DETAILED DESCRIPTION OF THE PREFERRED EMBODIMENTS

Preferred embodiments of the present invention are described below with reference to the accompanying drawings.

Figure 1:
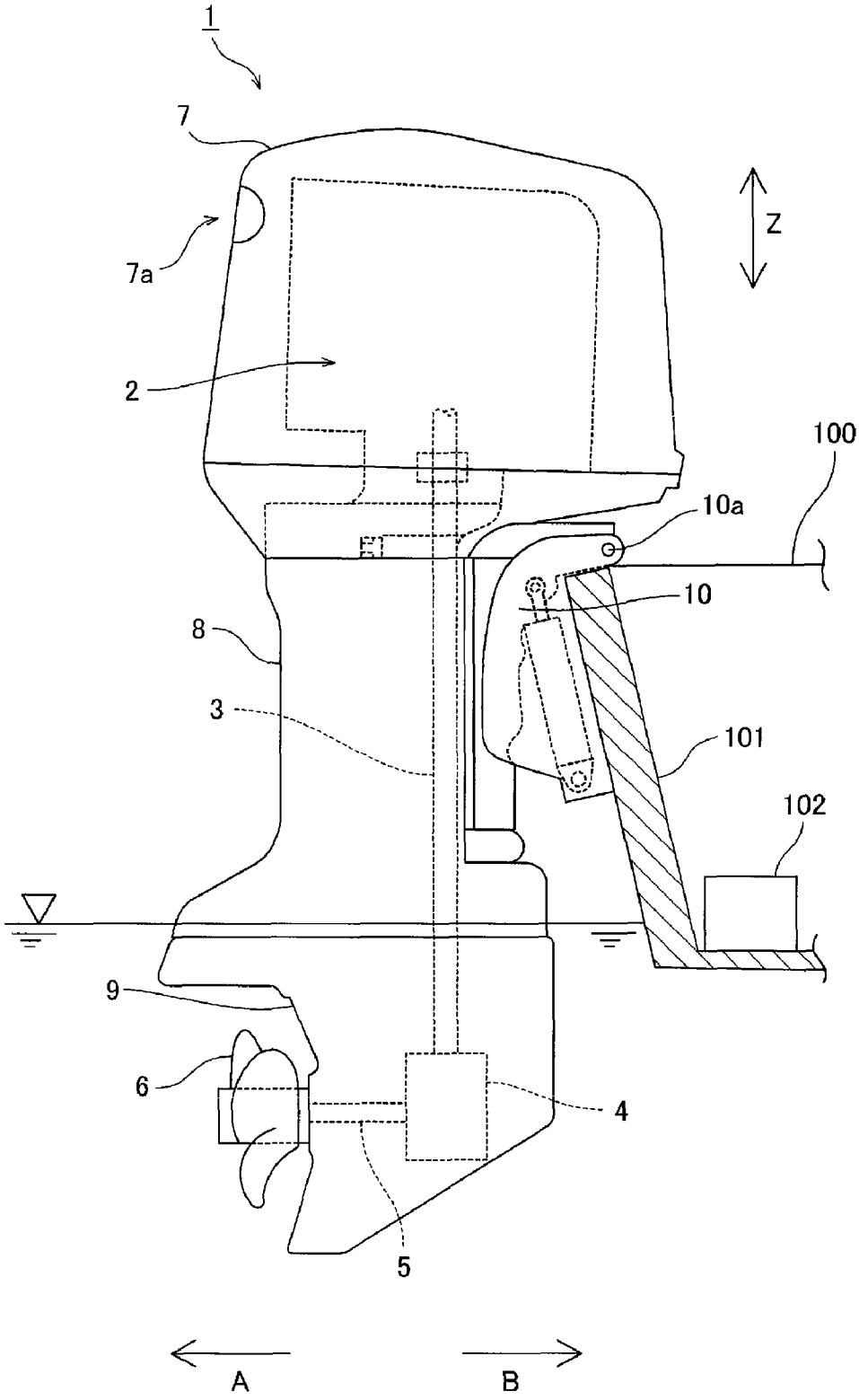
FIG. 1 is a side view showing a general construction of an outboard motor according to a preferred embodiment of the present invention.

FIG. 1 is a side view showing a configuration of an outboard motor that includes a fuel supply system for a boat according to a preferred embodiment of the present invention. FIGS. 2 to 13 are illustrations showing the detailed structure of an engine of the outboard motor shown in FIG. 1. FIG. 13 is a schematic diagram showing functions of each component defining the fuel supply system for a boat. The arrangement of each component (especially the location of a high-pressure fuel pump) in FIG. 13 is different from that in FIGS. 2 to 9. First, referring to FIGS. 1 to 13, the structure of an outboard motor 1 provided with a fuel supply system for a boat according to a preferred embodiment of the present invention will be described.

As shown in FIG. 1, the outboard motor 1 includes an engine section 2, a drive shaft 3 that is rotated by the driving force of the engine section 2 and extends vertically, a forward/reverse changing mechanism 4 connected to a lower end of the drive shaft 3, a propeller shaft 5 that is connected to the forward/reverse changing mechanism 4 and extends horizontally, and a propeller 6 attached to a rear end portion of the propeller shaft 5. The engine section 2 is housed in a cowling 7. In an upper case 8 and a lower case 9 arranged below the cowling 7, the drive shaft 3, the forward/reverse changing mechanism 4, and the propeller shaft 5 are housed. The outboard motor 1 is mounted to a transom plate 101 provided on a reverse direction (direction of an arrow "A") side of a hull 100 via a clamp bracket 10. The clamp bracket 10 supports the outboard motor 1 pivotally around a tilt shaft 10*a* in a vertical direction with respect to the hull 100. A fuel tank 102 for containing fuel (gasoline) is provided on the hull 100. Note that the fuel tank 102 is an example of the "first fuel tank" according to a preferred embodiment of the present invention. The fuel tank 102 and the engine section 2 of the outboard motor 1 are connected by a fuel pipe (not shown). The engine section 2 of the outboard motor 1 is driven using fuel supplied from the fuel tank 102. The propeller 6 is driven by the driving force of the engine section 2 and a rotational direction of the propeller 6 is changed by the forward/reverse changing mechanism 4, thereby propelling the hull 100 in a forward direction (direction of an arrow "B") or in a reverse direction (direction of the arrow "A"). A vent 7*a* is provided on a reverse direction (direction of the arrow "A") side portion of the cowling 7. Air supplied to the engine section 2 is taken in via the vent 7*a* into the engine section 2 in the cowling 7.

As shown in FIGS. 2 to 6, the engine section 2 includes an engine 20, an intake system 30 arranged to supply air to the engine 20, a fuel system 40 arranged to supply fuel to the engine 20, and an ECU (Engine Control Unit) 50 (see FIG. 13).

Figure 2:
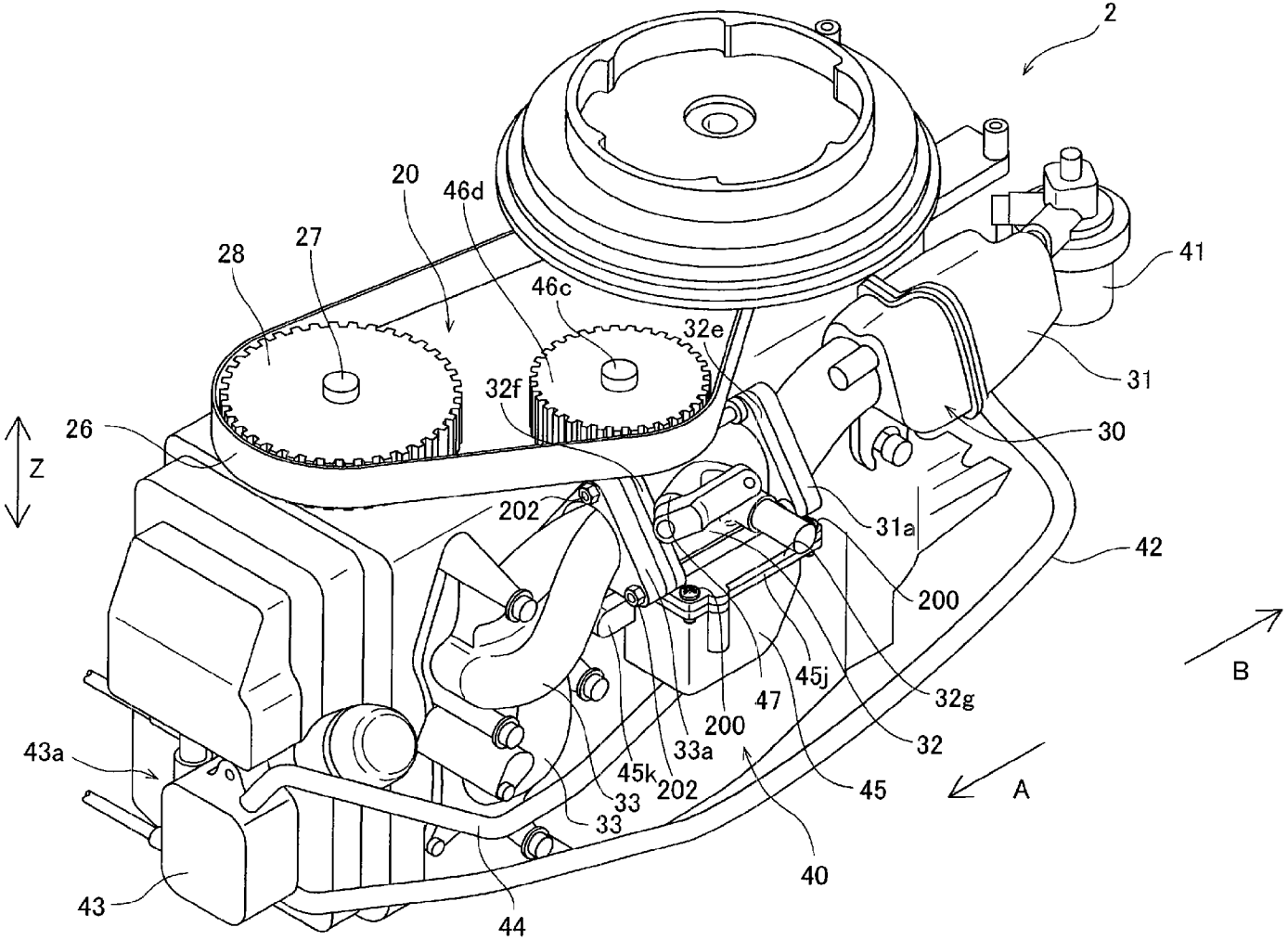
FIG. 2 is a perspective view showing an engine section of the outboard motor shown in FIG. 1.
Figure 3:
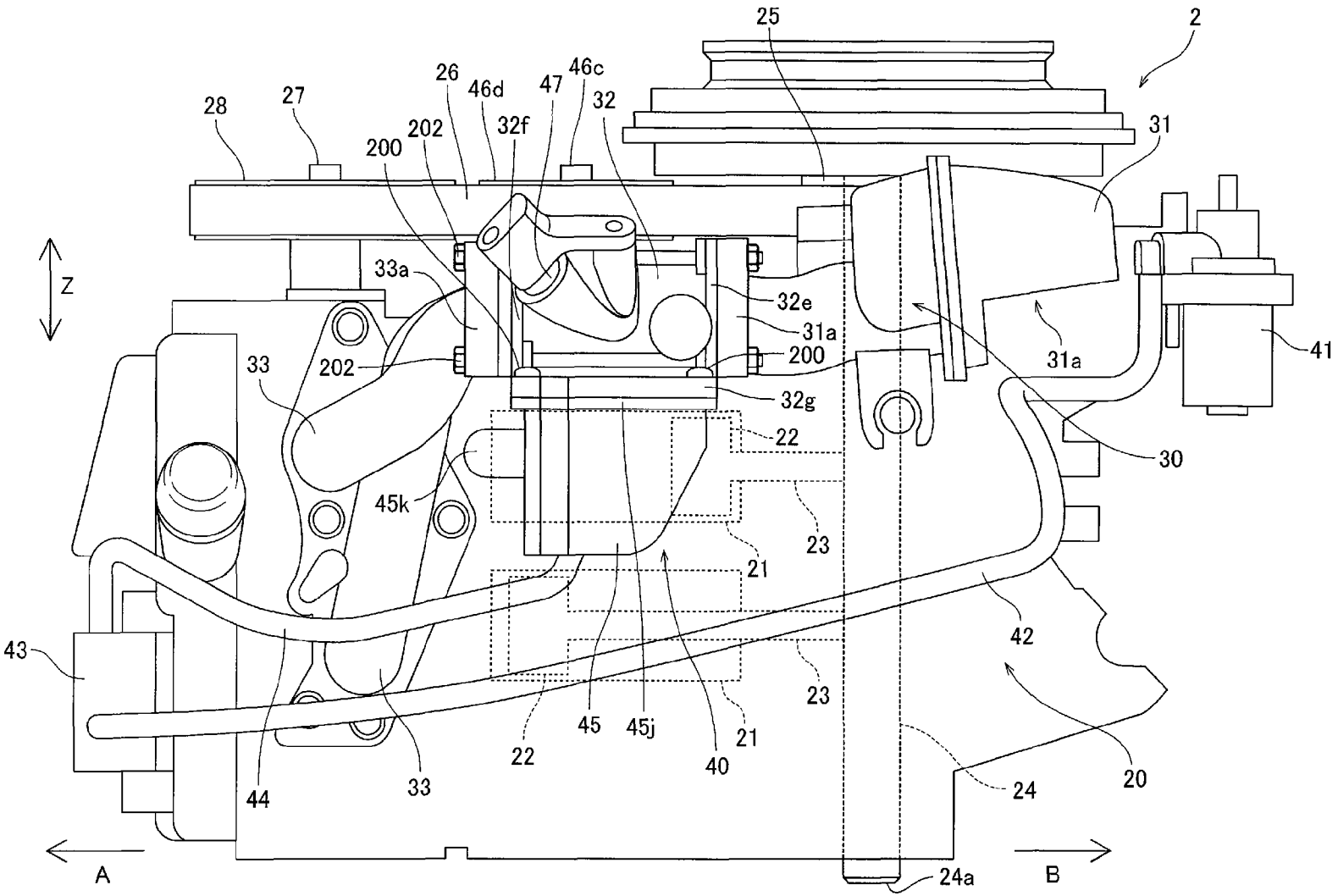
FIG. 3 is a side view showing the engine section of the outboard motor shown in FIG. 1.
Figure 4:
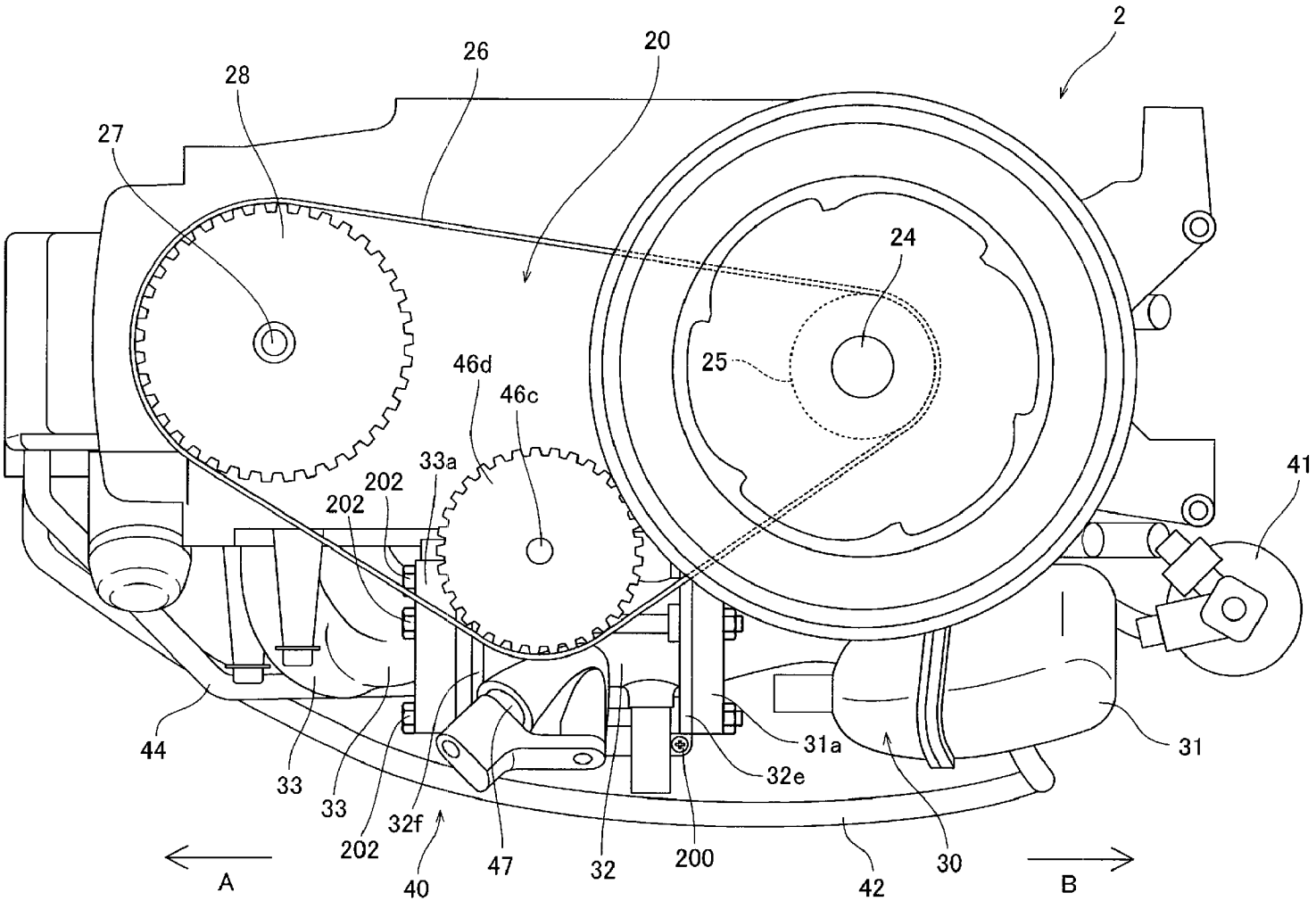
FIG. 4 is a top view showing the engine section of the outboard motor shown in FIG. 1.

As shown in FIG. 3, the engine 20 includes two cylinders 21 disposed parallel or substantially parallel to a vertical direction ("Z" direction) and two pistons 22 respectively reciprocating horizontally in each of the cylinders 21. Each of the pistons 22 is connected to a crankshaft 24 extending in a vertical direction ("Z" direction) via a connecting rod 23. A horizontal reciprocating motion of the piston 22 is converted to a rotational motion by the connecting rod 23 and the crankshaft 24. A lower end 24*a* of the crankshaft 24 is connected to the drive shaft 3 (see FIG. 1). As shown in FIGS. 2 to 6, rotation of the crankshaft 24 is transmitted to a camshaft 27 by a pulley 25 fixed at the top of the crankshaft 24, a belt 26, and a pulley 28 fixed to the camshaft 27. An intake valve (not shown) and an exhaust valve (not shown) of each cylinder 21 are driven at predetermined timings by the rotation of the camshaft 27.

Figure 6:
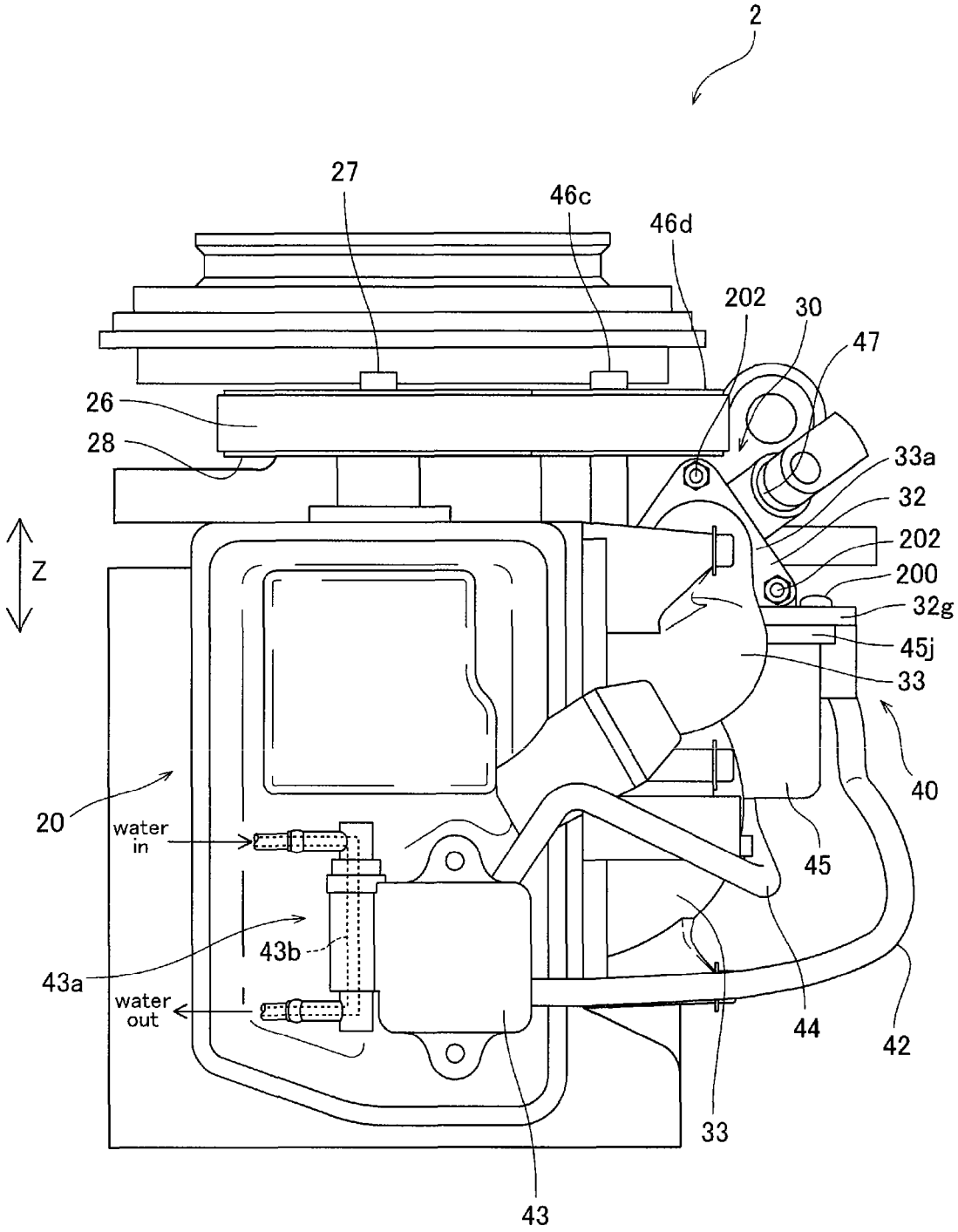
FIG. 6 is a front view showing the engine section of the outboard motor shown in FIG. 1.

As shown in FIGS. 2 and 6, the intake system 30 is disposed along a right side of the engine 20 when seen from a forward direction (direction of the arrow "B") of the engine 20. The intake system 30 includes a silencer case 31 that is disposed in a forward direction (direction of the arrow "B") side and has an inlet 31*a* (see FIG. 3), a throttle body 32 connected to the silencer case 31, and two intake pipes 33 respectively connected to an intake port (not shown) of each of the two cylinders 21 of the engine 20.

Figure 5:
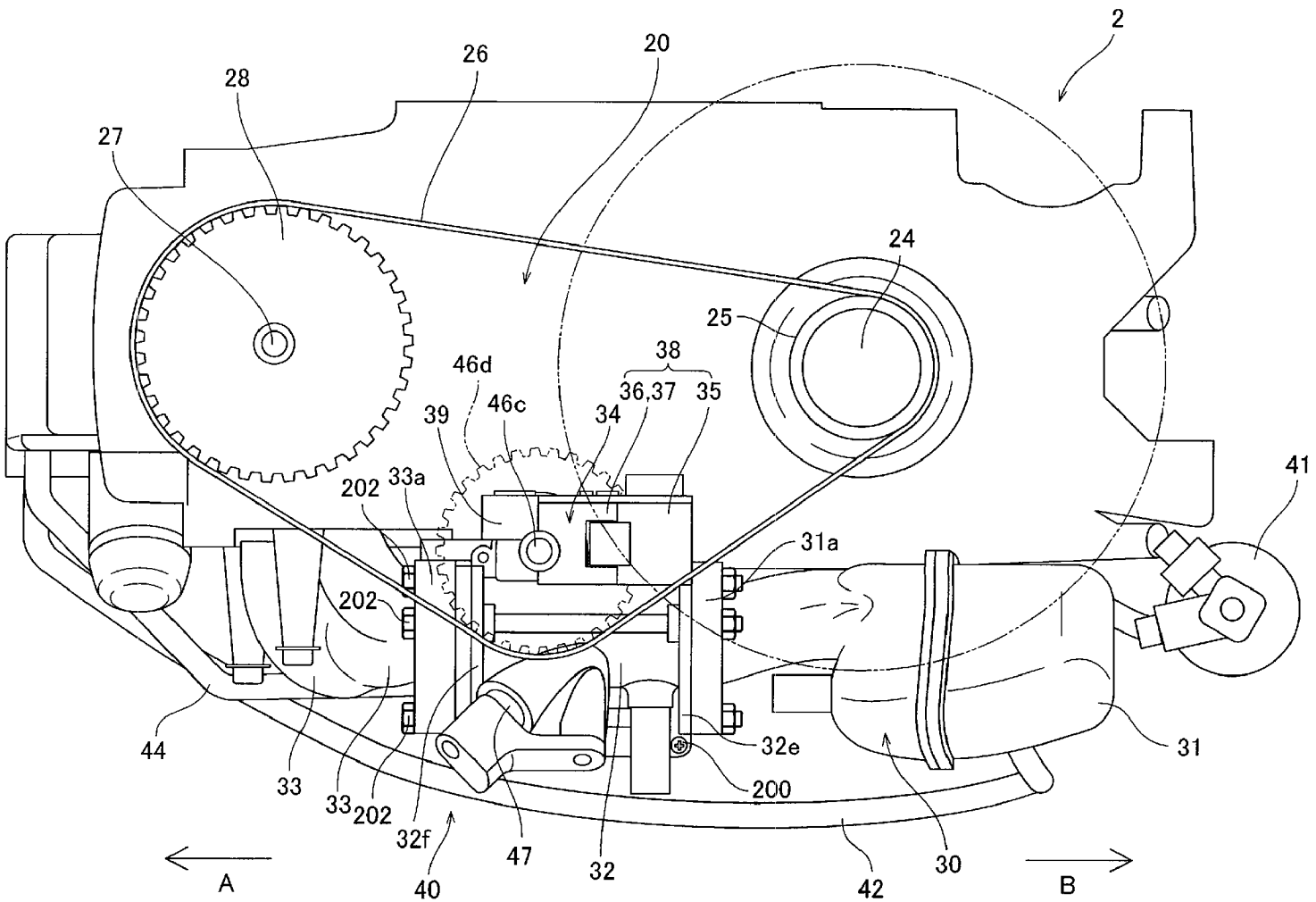
FIG. 5 is a top view showing the engine section of the outboard motor shown in FIG. 1.

As shown in FIGS. 7 to 9 and FIG. 13, the throttle body 32 is preferably made of resin (e.g., a plastic or any other suitable insulating polymeric material or material having low thermal conductivity, hereinafter referred to generally as a resin) or metal and has a cylindrical air passage 32*a*. A butterfly-type throttle valve 32*b* (see FIGS. 9 and 13) is provided in the air passage 32*a*. As shown in FIG. 13, a bypass air passage 32*c* that connects an upstream side and a downstream side of the air passage 32*a* relative to the throttle valve 32*b* is provided in the throttle body 32. The bypass air passage 32*c* provides an air flow rate during idling when the throttle valve 32*b* is completely closed. At both ends in an airflow direction of the air passage 32*a* of the throttle body 32, a flange 32*e* and a flange 32*f* are provided. A rectangular flange 32*g* is provided in a lower portion of the throttle body 32. The flange 32*g* preferably has four screw holes (not shown) at its four corners. In the bypass air passage 32*c*, an ISC (Idle Speed Control) unit 34 having a valve arranged to control the air flow rate in the bypass air passage 32*c* is provided. The engine speed during idling can be controlled by adjusting the opening degree of the valve of the ISC unit 34. The throttle body 32 also has a throttle opening sensor 35 arranged to detect the opening degree of the throttle valve 32*b*, an intake air pressure sensor 36 arranged to detect air pressure in the air passage 32*a*, and an intake air temperature sensor 37 arranged to detect air temperature in the air passage 32*a*. As shown in FIG. 5, the ISC unit 34 and a sensor section 38 including the throttle opening sensor 35, the intake air pressure sensor 36, and the intake air temperature sensor 37 are attached to an upper portion of the throttle body 32. The ISC unit 34 and the sensor section 38 are connected to an ECU 50 (see FIG. 13) via a connector 39.

Figure 7:
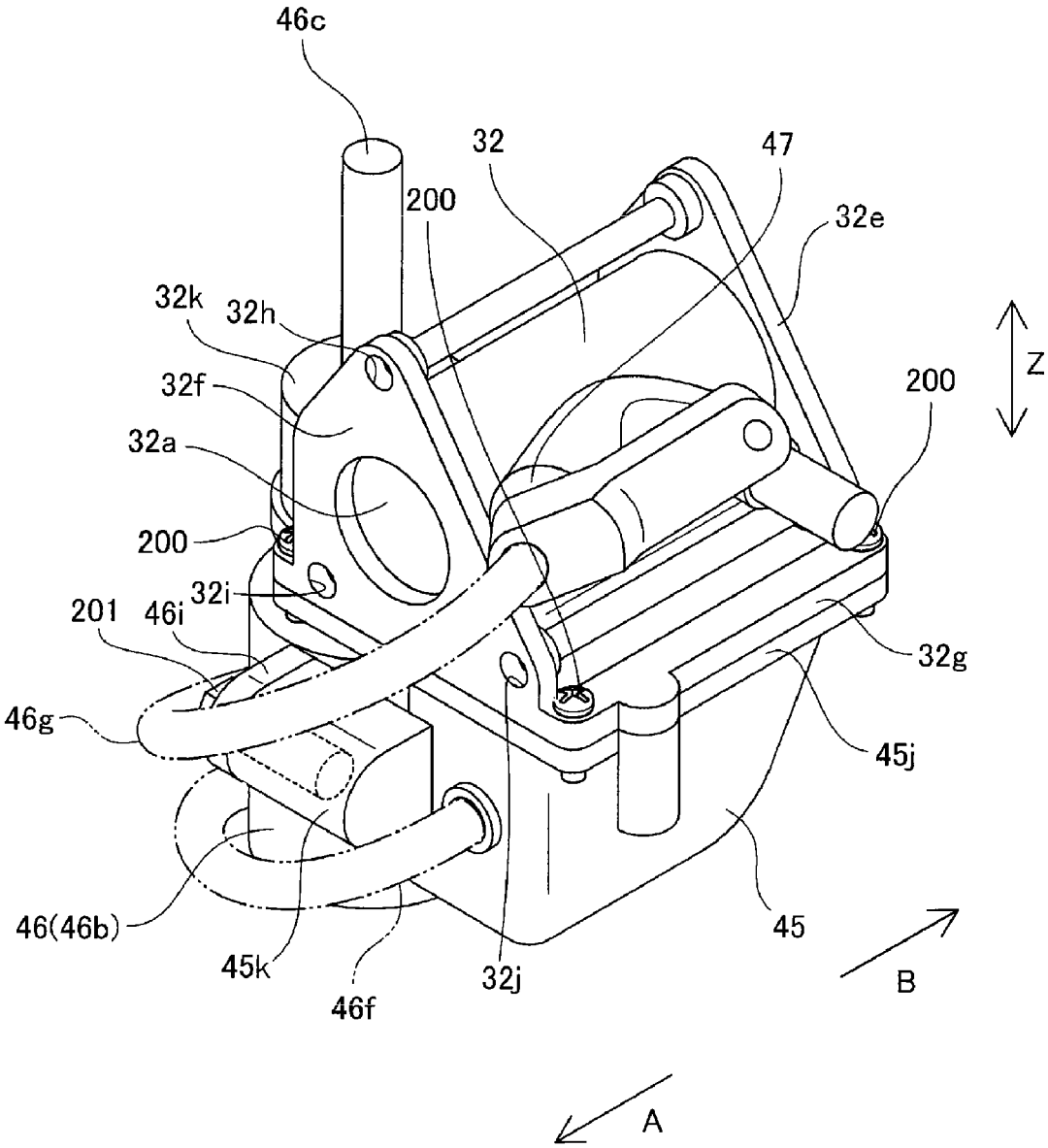
FIG. 7 is a perspective view showing a throttle body and its vicinity in the engine section of the outboard motor shown in FIG. 1.

As shown in FIGS. 2 to 6, a flange 31*a* is provided at an end on the throttle body 32 side of the silencer case 31 while a flange 33*a* is provided at an end on the throttle body 32 side of the intake pipe 33. As shown in FIG. 7, a screw hole 32*h* is provided on an upper portion of the flange 32*f* of the throttle body 32 on the intake pipe 33 side. On a lower portion of the flange 32*f*, two screw holes 32*i*, 32*j* are preferably provided. On the flange 32*e* of the throttle body 32 on the silencer case 31 side, on the flange 33*a* of the intake pipe 33, and on the flange 31*a* of the silencer case 31, screw holes (not shown) are provided, which are positioned to correspond to screw holes 32*h* to 32*j* on the flange 32*f* of the throttle body 32 on the intake pipe 33 side. As shown in FIGS. 2 to 6, screw holes provided on respective flanges 32*e*, 32*f*, 31*a*, 33*a* are penetrated by three long screws 202, for example, to fasten the silencer case 31, throttle body 32, and the intake pipe 33 to each other.

As shown in FIGS. 2 to 7 and FIG. 13, the fuel system 40 includes a filter 41 connected to the fuel tank 102 disposed on the hull 100, a low-pressure fuel pump 43 connected to the filter 41 via a fuel pipe 42 preferably made of rubber or resin (or any other suitable flexible polymeric or elastomeric material), a vapor separator tank 45 connected to the low-pressure fuel pump 43 via a fuel pipe 44 made of rubber or resin(or any other suitable polymeric or elastomeric material), a high-pressure fuel pump 46 (see FIG. 7) arranged to transport fuel contained in the vapor separator tank 45, and an injector 47 arranged to inject the fuel transported by the high-pressure fuel pump 46. Note that the vapor separator tank 45, the high-pressure fuel pump 46, and the injector 47, respectively, are examples of the "second fuel tank," the "fuel supply pump," and the "fuel injection device" according to a preferred embodiment of the present invention.

As shown in FIG. 6, the low-pressure fuel pump 43 is a so-called diaphragm type fuel pump including a piston (not shown) and a diaphragm (not shown). The piston of the low-pressure fuel pump 43 is configured to be reciprocated in conjunction with rotation of a cam (not shown) attached to the camshaft 27 of the engine 20 (see FIG. 2). The diaphragm is configured to be reciprocated corresponding to the reciprocation of the piston, thereby transporting fuel. A water-cooling section 43*a* is provided on a side portion of the low-pressure fuel pump 43. The water-cooling section 43*a* has a pipe 43*b* extending along the side portion of the low-pressure fuel pump 43 and allows the pipe 43*b* to pass sea water, thereby cooling the low-pressure fuel pump 43. Since the fuel pumped up from the fuel tank 102 on the hull 100 by the low-pressure fuel pump 43 passes through the filter 41, foreign matter and the like contained in the fuel are eliminated.

Figure 8:
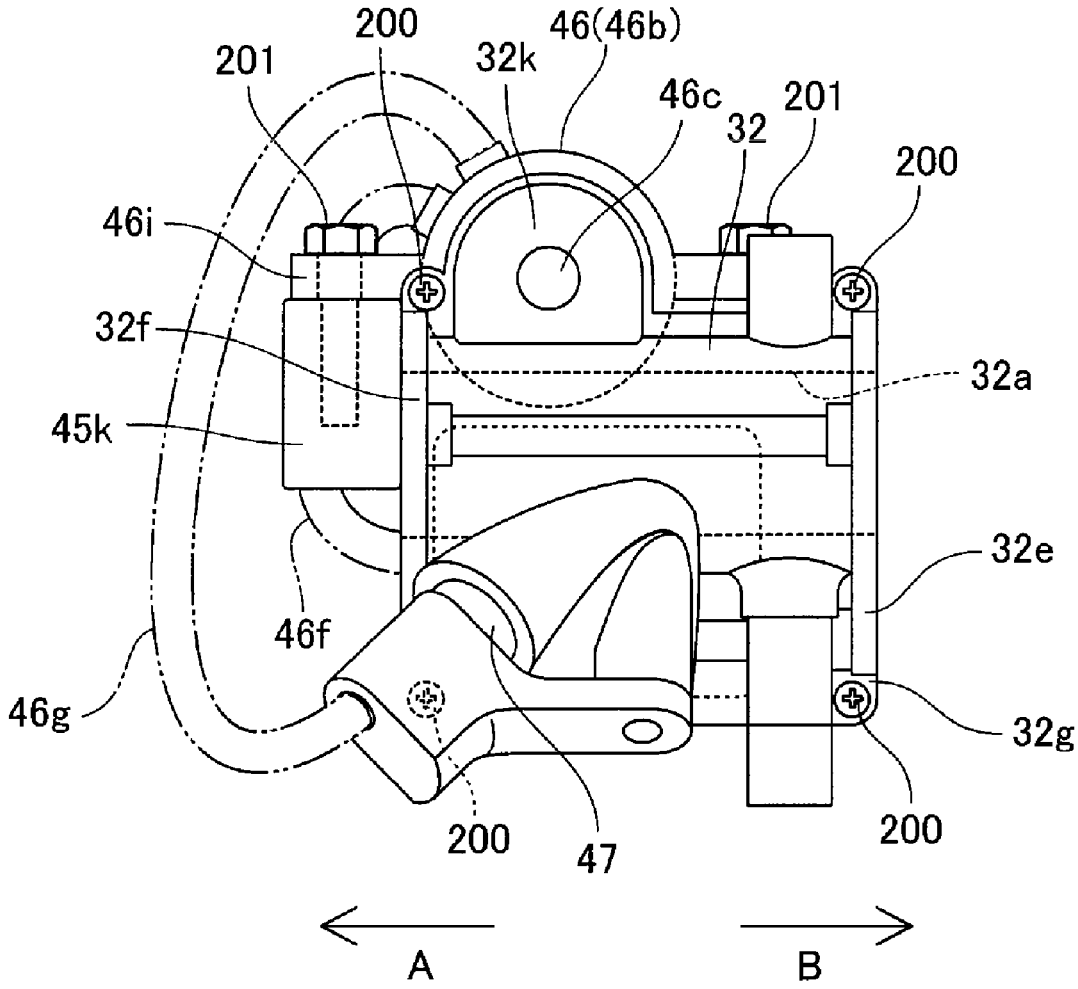
FIG. 8 is a top view showing the throttle body and its vicinity in the engine section of the outboard motor shown in FIG. 1.
Figure 9:
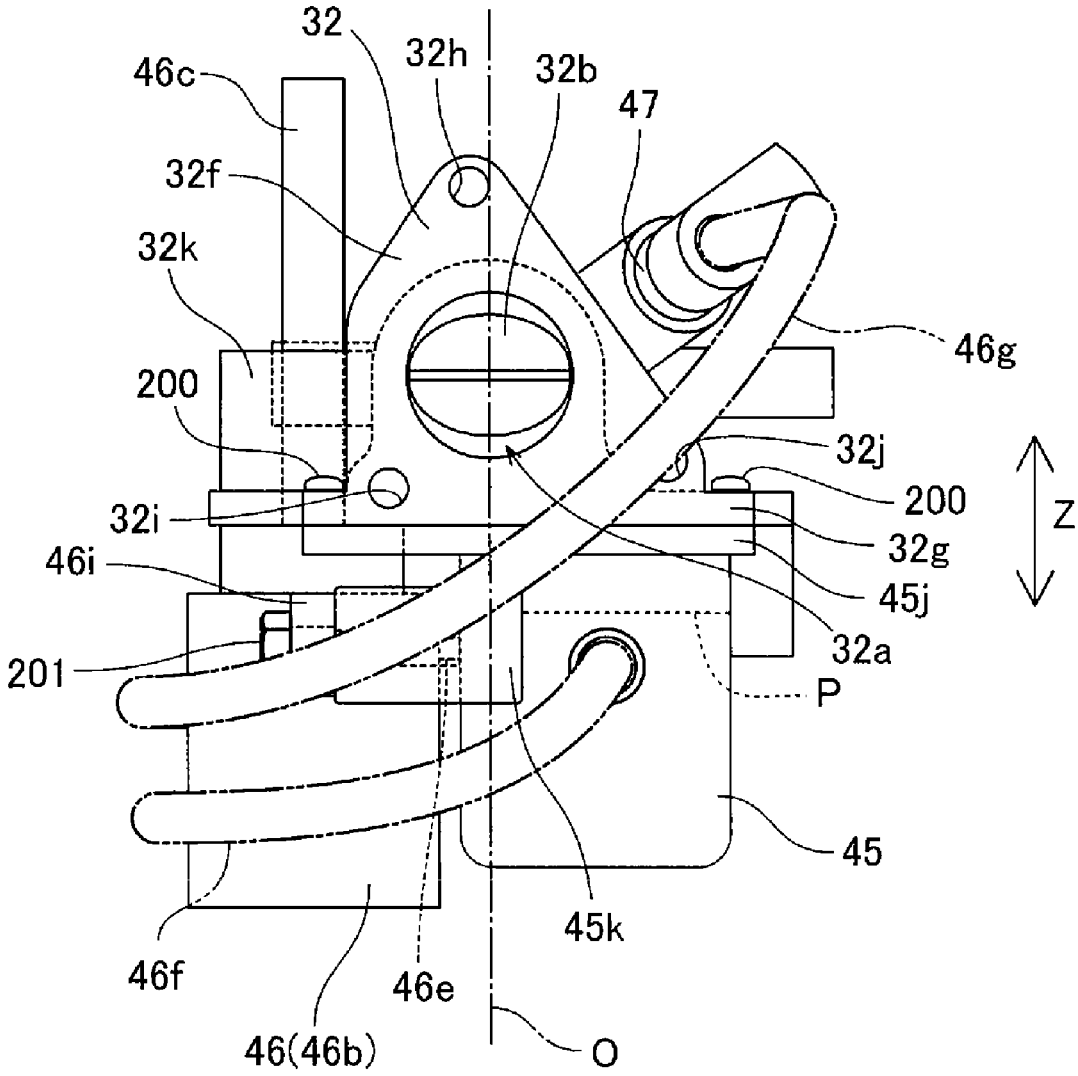
FIG. 9 is a front view showing the throttle body and its vicinity in the engine section of the outboard motor shown in FIG. 1.

The fuel sent out by the low-pressure fuel pump 43 via the fuel pipe 44 is discharged from an outlet 45*a* (see FIG. 13) into the vapor separator tank 45 to be contained therein. The vapor separator tank 45 is preferably made of resin and disposed adjacent to and below the throttle body 32 to contact with the throttle body 32. In this preferred embodiment, as shown in FIGS. 7 to 9, a rectangular flange 45*j* is provided on an upper portion of the vapor separator tank 45 and screw holes (not shown) are provided at four corners of the flange 45*j*. The four screw holes (not shown) provided on the flange 32*g* of the throttle body 32 and the four screw holes (not shown) provided on the flange 45*j* of the vapor separator tank 45 are penetrated by screws 200, for example, at four locations to fasten the throttle body 32 and the vapor separator tank 45. A projection 45*k* is integral with the vapor separator tank 45 to project from a side surface on the intake pipe 33 side (see FIG. 2). A screw hole is provided on the projection 45*k*. A screw hole (not shown) is also provided on a side surface on the high-pressure fuel pump 46 side of the vapor separator tank 45.

The vapor separator tank 45 contains the fuel pumped up from the fuel tank 102 and separates the vaporized fuel (vapor) or air from the liquid fuel. As shown in FIG. 13, the vapor separator tank 45 is configured such that the contained quantity of fuel in the tank is kept constant and the fuel in the tank is kept at a predetermined level "P." Specifically, a float 45*c* pivotable about a pivot shaft 45*b* in a vertical direction ("Z" direction) is provided in the vapor separator tank 45. A needle valve 45*d* is provided in the float 45*c* at a position corresponding to the outlet 45*a*. Since the float 45*c* moves in a vertical direction as the fuel level in the vapor separator tank 45 moves, the needle valve 45*d* moves in a vertical direction corresponding to the movement of the float 45*c*. If the fuel level in the vapor separator tank 45 becomes higher than the predetermined level "P," the float 45*c* rises to insert the needle valve 45*d* into the outlet 45*a*, thereby automatically stopping the inflow of fuel into the vapor separator tank 45. If the fuel level in the vapor separator tank 45 is lower than the predetermined level "P," the float 45*c* descends to separate the needle valve 45*d* from the outlet 45*a*, thereby automatically allowing the inflow of fuel into the vapor separator tank 45. With the above described mechanism, the contained quantity of fuel in the vapor separator tank 45 is kept constant and the fuel in the tank is kept at the predetermined level "P."

At the bottom of the vapor separator tank 45, there is provided a water sensor 45*e* arranged to detect water collected at the bottom of the vapor separator tank 45. Specifically, a central portion 45*f* of the bottom of the vapor separator tank 45 protrudes upward. The protruded portion defines a recess as seen from the outside below the vapor separator tank 45. Two leads 451, 452 are disposed in the recess and tips of the leads 451, 452 are connected. Also, a pair of floats 45*g* that are floatable in water are provided at the bottom of the vapor separator tank 45. Each of the pair of floats 45*g* has a built-in magnet (not shown). When water is collected in the bottom of the vapor separator tank 45, the float 45*g* having a magnet rises as a water level "Q" rises. When the floats 45*g* rise up to a predetermined position, the tip of the lead 451 and the tip of the lead 452 are separated from each other by magnetic forces from the magnets. Accordingly, the connection between the leads 451, 452 is interrupted. With the above configured water sensor 45*e*, it is possible to detect whether or not an amount of water that is collected equal to or more than a predetermined quantity in the bottom of the vapor separator tank 45.

A leading end 46*h* of a pipe 46*f* is inserted into an upper portion of the vapor separator tank 45. The pipe 46*f* is connected to the high-pressure fuel pump 46, which will be described below. The fuel returned from the high-pressure fuel pump 46 is discharged from the leading end 46*h* of the pipe 46*f* into the vapor separator tank 45. A buffer plate 45*h* is disposed below the leading end 46*h* of the pipe 46*f* and above the float 45*c* in the vapor separator tank 45. A plurality of small holes are provided in the buffer plate 45*h*. Fuel is discharged from the leading end 46*h* of the pipe 46*f* via the holes of the buffer plate 45*h* into the vapor separator tank 45 to be contained therein again. When the fuel discharged from the leading end 46*h* of the pipe 46*f* bubbles, the buffer plate 45*h* can drip the liquid fuel into the vapor separator tank 45 without dropping bubbles.

A check valve 45*i* is provided in a communication passage between the vapor separator tank 45 and the throttle body 32. The check valve 45*i* is configured to pass vapor (vaporized fuel) or air only in one direction from the vapor separator tank 45 to the throttle body 32. When vapor occurs to increase an internal pressure of the vapor separator tank 45, the check valve 45*i* opens to discharge the vapor from the vapor separator tank 45 to the throttle body 32. Also, when the engine (engine section 2) is operated, the negative pressure in the throttle body 32 opens the check valve 45*i* to discharge the vapor from the vapor separator tank 45 to the throttle body 32.

Figure 10:
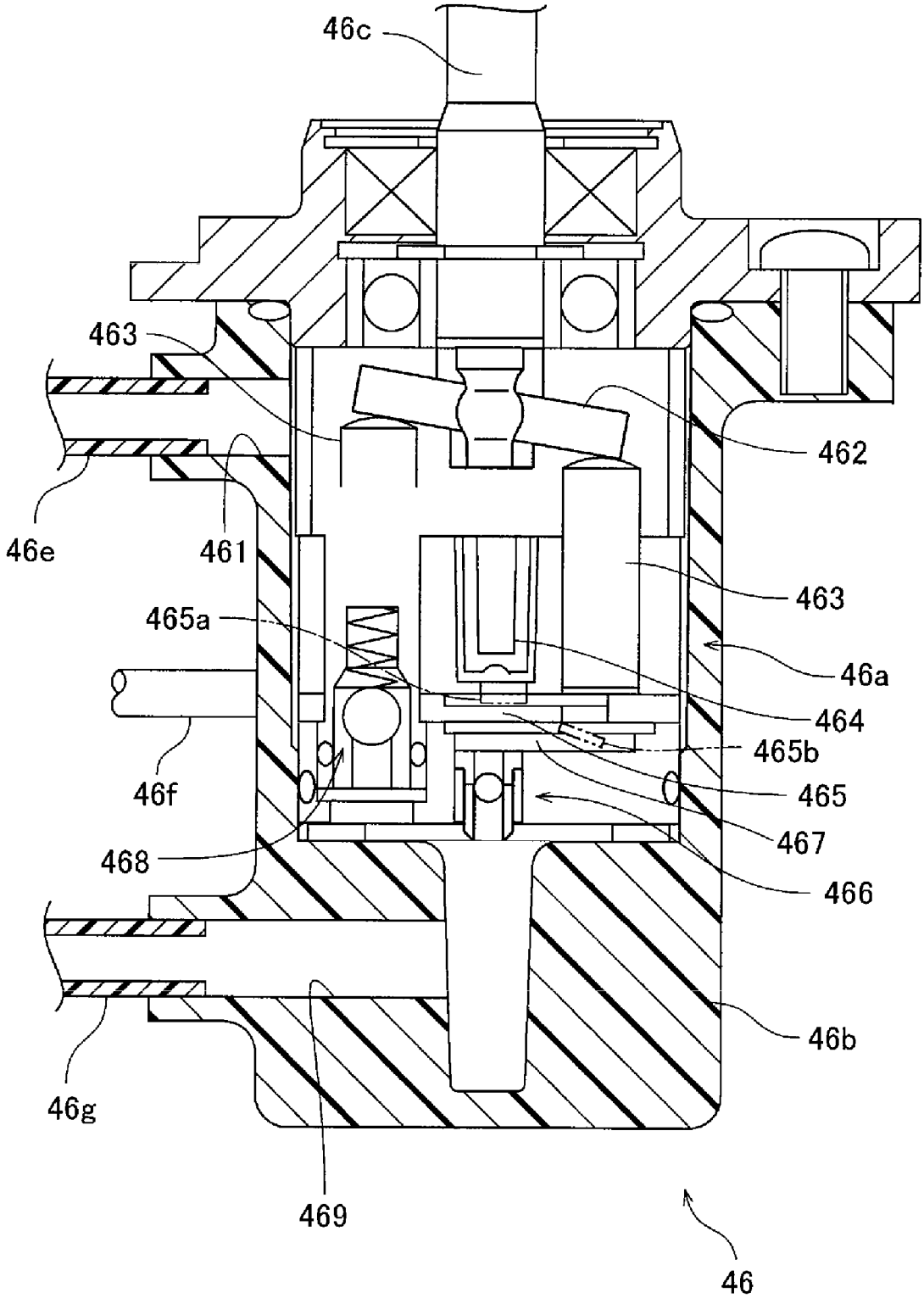
FIG. 10 is a partial sectional view showing the internal structure of a high-pressure fuel pump in the engine section of the outboard motor shown in FIG. 1.

As shown in FIGS. 7 to 9, the high-pressure fuel pump 46 is a so-called in-line type fuel pump that is disposed outside the vapor separator tank 45 and interposed between fuel pipes. A projection 46*i* and a projection (not shown) projecting toward the silencer case 31 side are preferably integral with the high-pressure fuel pump 46. The projection 46*i* projects toward the intake pipe 33 side in a direction in which the air passage 32*a* of the throttle body 32 extends from a side surface of an outer frame 46*b*. A screw insertion hole is respectively provided in these two projections (the projection 46*i* and the projection not shown). Two screw holes in the vapor separator tank 45 (the screw hole provided on the projection 45*k* and the screw hole provided on the side surface on the high-pressure fuel pump 46 side, which is not shown) and screw insertion holes provided in the projections (the projection 46*i* and the projection not shown) are penetrated by screws 201, for example, to fixedly fasten the high-pressure fuel pump 46 to the side portion of the vapor separator tank 45 at two locations. The high-pressure fuel pump 46 is preferably made of resin as a base material. More specifically, as shown in FIG. 10, the high-pressure fuel pump 46 is configured such that a pump main portion 46*a* having a fuel path is retained by the outer frame 46*b* preferably made of resin. The outer frame 46*b* is fixed to the vapor separator tank 45 preferably by screws 201, for example, (see FIGS. 8 and 9). The pump main portion 46*a* is configured to transport fuel by rotating a rotary shaft 46*c*. In this preferred embodiment, as shown in FIGS. 2 to 6, a pulley 46*d* is fixed at an upper end of the rotary shaft 46*c*. The pulley 46*d* is meshed with the belt 26 together with the pulley 25 of the crankshaft 24 and the pulley 28 of the camshaft 27. Thus, as the crankshaft 24 is rotated by the driving force of the engine 20, the pulley 46*d* and the rotary shaft 46*c* are rotated to drive the pump main portion 46*a*. Note that the pulley 46*d* is an example of the "pump driving section" according to a preferred embodiment of the present invention.

Figure 11:
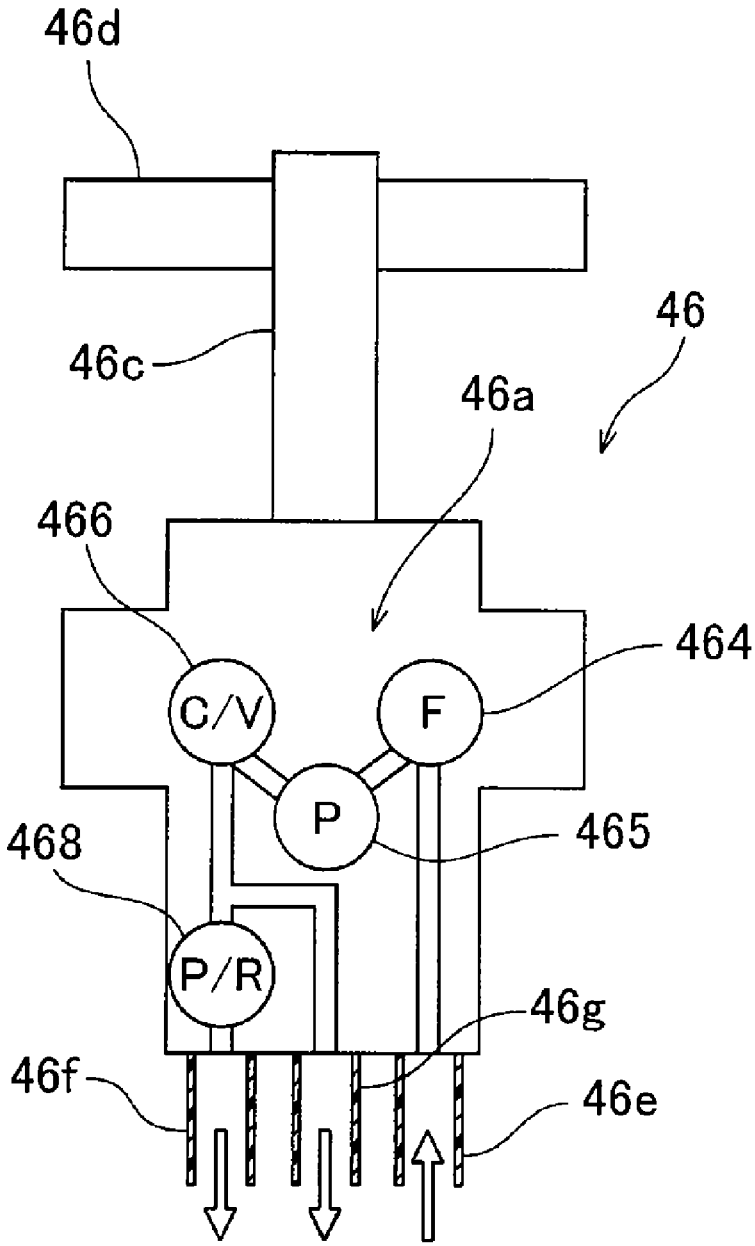
FIG. 11 is a schematic view showing the high-pressure fuel pump in the engine section of the outboard motor shown in FIG. 1.
Figure 12:
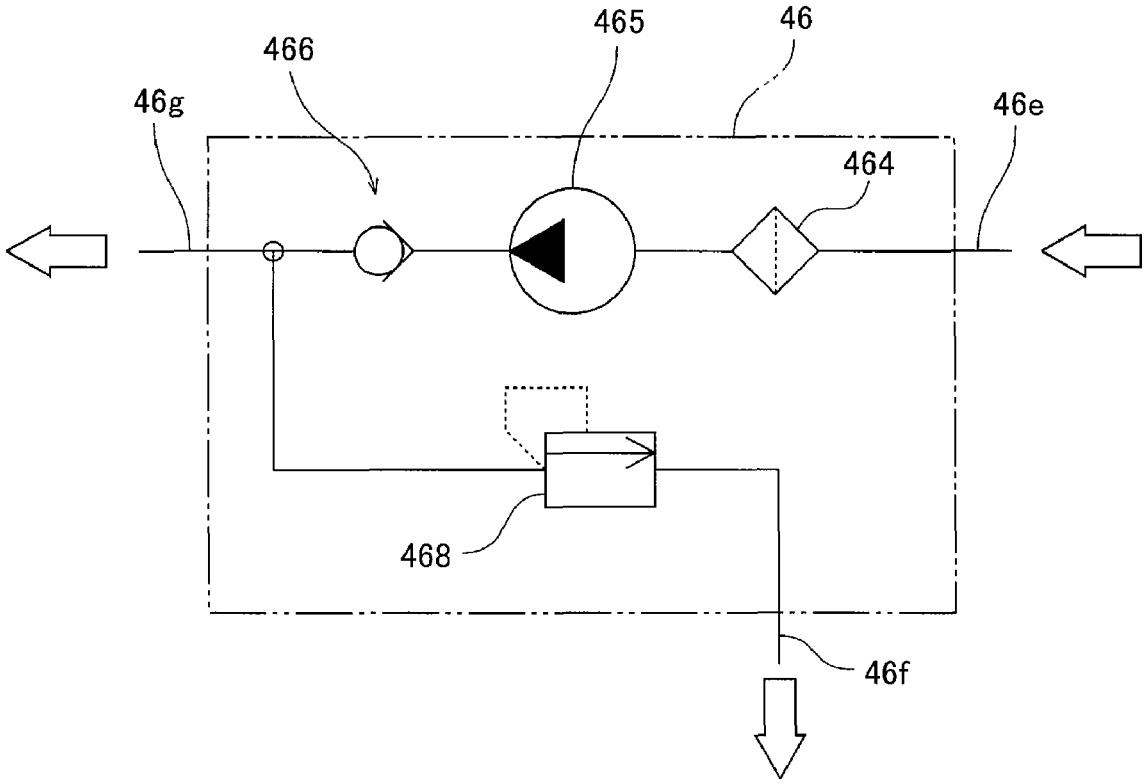
FIG. 12 is a hydraulic circuit diagram of the high-pressure fuel pump in the engine section of the outboard motor shown in FIG. 1.
Figure 13:
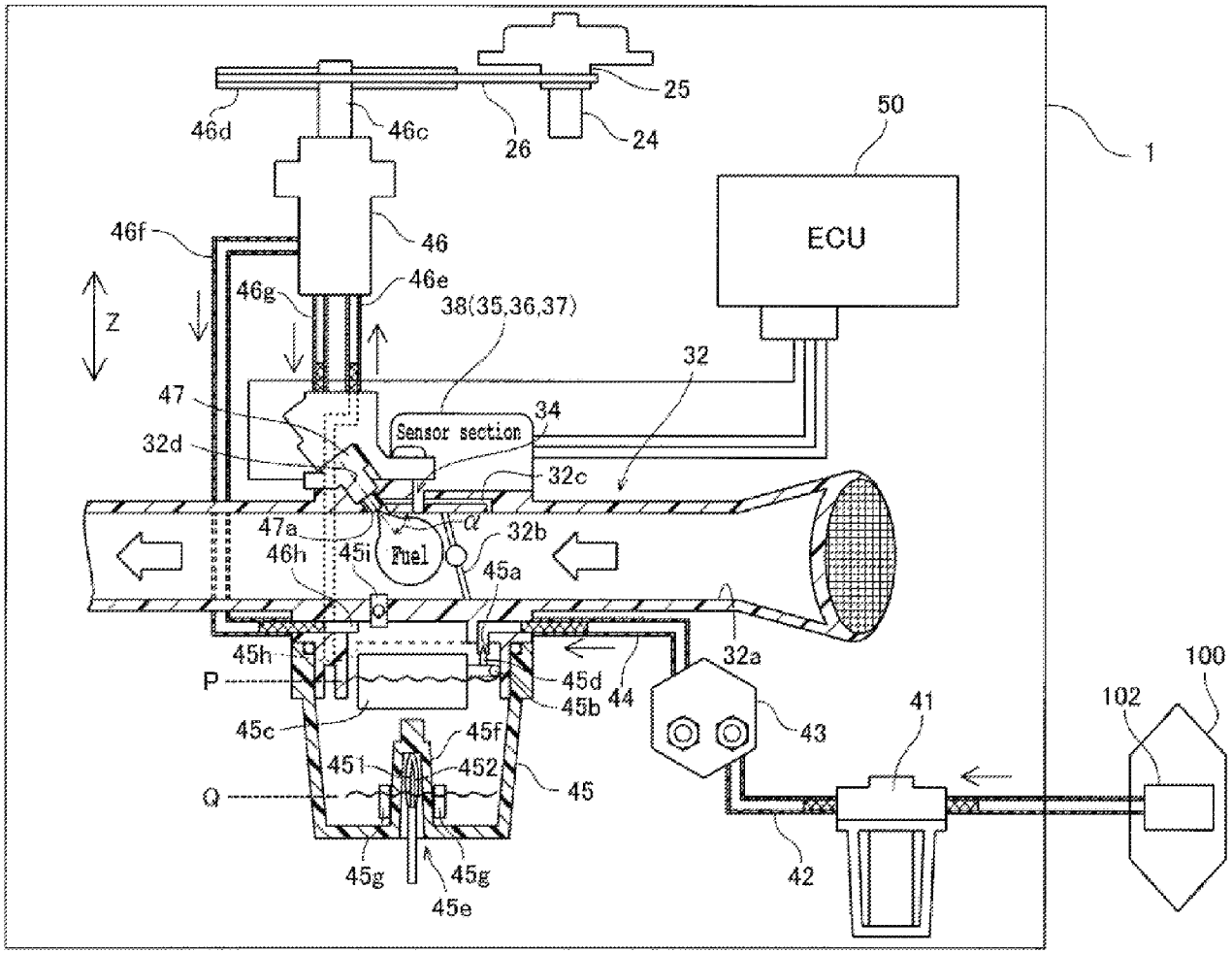
FIG. 13 is a schematic view showing a fuel supply system of the outboard motor of FIG. 1.

As shown in FIGS. 10 to 12, the pump main portion 46*a* includes an inlet 461 connected to the vapor separator tank 45 via a resin pipe 46*e*, a swash plate 462 fixed aslant to the rotary shaft 46*c*, a plunger 463*m*, a filter 464, a reserving chamber 465 arranged to temporarily contain fuel, a reserving chamber 467 containing a fuel pressure retaining valve 466, a relief valve 468 connected to the vapor separator tank 45 via a resin pipe 46*f*, and an outlet 469 connected to the injector 47 (see FIG. 13) via a resin pipe 46*g*. The inlet 461, the filter 464, the reserving chamber 465, the reserving chamber 467, the relief valve 468, and the outlet 469 define an example of the "fuel path" according to a preferred embodiment of the present invention. An upper end of the plunger 463 abuts a lower surface of the swash plate 462. As the swash plate 462 together with the rotary shaft 46*c* rotates, the plunger 463 moves in a vertical direction. When the plunger 463 moves upward, fuel is drawn from the vapor separator tank 45 into the reserving chamber 465 via the inlet 461 and the filter 464. When the plunger 463 moves downward, fuel is pushed out from the reserving chamber 465 to the reserving chamber 467. There are provided a lead valve 465*a* and a lead valve 465*b*, respectively, between the filter 464 and the reserving chamber 465 and between the reserving chamber 465 and the reserving chamber 467. These valves open when fuel flows in a transport direction (direction from the inlet 461 to the outlet 469) and close when fuel attempts to flow in the opposite direction. When fuel is drawn from the filter 464 into the reserving chamber 465, the lead valve 465*a* opens and the lead valve 465*b* closes at the same time as the plunger 463 moves upward. When fuel is pushed out from the reserving chamber 465 to the reserving chamber 467, the lead valve 465*a* closes and the lead valve 465*b* opens at the same time as the plunger 463 moves downward. When the pressure of the fuel contained in the reserving chamber 467 becomes equal to or larger than a predetermined value, the fuel is discharged from the outlet 469 via the fuel pressure retaining valve 466. The outlet 469 is connected to the relief valve 468. When pressure at the outlet 469 excessively increases when the injector 47 (see FIG. 13) is plugged with fuel, for example, fuel is discharged into the vapor separator tank 45 (see FIG. 13) via the relief valve 468 and the pipe 46*f*.

In this preferred embodiment, as shown in FIG. 9, below the throttle body 32, the vapor separator tank 45 is placed on one side of a center line "O" as a general center extending in a vertical direction (up-and-down direction) and crossing the central axis of the air passage 32*a* of the throttle body 32, while the pump main portion 46*a* of the high-pressure fuel pump 46 is placed on the other side. As shown in FIGS. 7 to 9, the pump main portion 46*a* of the high-pressure fuel pump 46 is disposed below the throttle body 32 and the rotary shaft 46*c* is configured to extend upward. In the vicinity of the air passage 32*a* of the throttle body 32, a bearing portion 32*k* is preferably integral with the throttle body 32 to retain the rotary shaft 46*c* to be rotatable. As seen from the top, the rotary shaft 46*c* is positioned out of the air passage 32*a* of the throttle body 32 and retained by the bearing portion 32*k*. The high-pressure fuel pump 46 and the vapor separator tank 45 are supported by the throttle body 32 and spaced away from the engine 20.

As shown in FIG. 13, the injector 47 has a function to inject the fuel sent out at a predetermined pressure by the high-pressure fuel pump 46 at predetermined timing. In this preferred embodiment, the injector 47 is mounted into a mounting hole 32*d* of the throttle body 32. The injector 47 is configured to inject fuel in a direction opposite to an airflow direction in the air passage 32*a* of the throttle body 32. The direction of fuel injection is tilted at an angle of $\alpha$ (about 20 to about 60 degrees, for example) relative to the airflow direction. Fuel injection in the opposite direction to the airflow direction allows the injected fuel to be atomized and spread evenly throughout the air passage 32*a* and prevents the fuel from attaching to an inner surface of the air passage 32*a*. An injection nozzle 47*a* of the injector 47 is disposed in a downstream vicinity of the throttle valve 32*b*. Fuel is injected from the injection nozzle 47*a* of the injector 47 toward the throttle valve 32*b*. Also, the injection nozzle 47*a* of the injector 47 is positioned at an exit of the bypass air passage 32*c*. Thus, fuel is injected into a faster portion of the airflow. This facilitates fuel atomization. In this preferred embodiment, with the above configuration, fuel can be distributed evenly to the two intake pipes 33 by the single injector 47.

In this preferred embodiment, as described above, the vapor separator tank 45 is disposed adjacent to the throttle body 32 including the throttle valve 32*b*. Accordingly, the vapor separator tank 45 that receives heat radiated from the engine 20 can be cooled by the throttle body 32 having a relatively low temperature. More specifically, air flows fastest in the throttle body 32, rapidly drawing heat from the throttle body 32. As a result, the throttle body 32 becomes resistant to an increase in temperature. Being disposed adjacent to the vapor separator tank 45, the throttle body 32 has a relatively low temperature which can cool the vapor separator tank 45 that receives heat radiated from the engine 20. This minimizes an increase in the temperature in the vapor separator tank 45, thereby minimizing the generation of vapor (vaporized fuel)

in the vapor separator tank 45. Therefore, it is possible to prevent fuel from returning to the fuel tank 102 mounted on the hull, thereby minimizing the fuel reduction in the vapor separator tank 45. As a result, it becomes easy for the high-pressure fuel pump 46 to pump fuel up from the vapor separator tank 45 and supply fuel to the injector 47 during a restart of the engine section 2. Deterioration in startability of the engine section 2 can thereby be minimized.

In this preferred embodiment, as described above, the vapor separator tank 45 and the high-pressure fuel pump 46 are spaced away from the engine 20. That is, the vapor separator tank 45 and the high-pressure fuel pump 46 are not directly attached to the engine 20. This minimizes direct heat transmission from the engine 20 to the vapor separator tank 45 and the high-pressure fuel pump 46. Thus, a temperature increase in the vapor separator tank 45 and the high-pressure fuel pump 46 can be minimized, thereby minimizing the generation of vapor in the vapor separator tank 45 and the high-pressure fuel pump 46.

In this preferred embodiment, as described above, the vapor separator tank 45 and the throttle body 32 are preferably fixed by screws 200, for example, so as to be adjacent to and contact with each other.

In this preferred embodiment, as described above, the check valve 45*i* is arranged to allow the vaporized fuel in the vapor separator tank 45 to pass only in a direction from the vapor separator tank 45 to the throttle body 32. When vaporized fuel collects in the vapor separator tank 45, the check valve 45*i* is opened by the pressure of the vaporized fuel to automatically release the vaporized fuel in the vapor separator tank 45 to the throttle body 32. In this preferred embodiment, the vapor separator tank 45 and the throttle body 32 are disposed adjacent to each other so as to contact each other. Therefore, the vaporized fuel in the vapor separator tank 45 can be released without utilizing an extra pipe for connecting the vapor separator tank 45 and the throttle body 32 as in the case where the vapor separator tank 45 and the throttle body 32 are separated from each other.

In this preferred embodiment, as described above, the high-pressure fuel pump 46 is preferably disposed outside of and adjacent to the vapor separator tank 45. Therefore, the pipes 46*e*, 46*f* arranged to connect the high-pressure fuel pump 46 and the vapor separator tank 45 can be shortened, thereby decreasing a heat-receiving area that receives heat radiated from the engine 20. This minimizes the generation of vaporized fuel.

In this preferred embodiment, as described above, the vapor separator tank 45 is disposed below and adjacent to the throttle body 32 and the high-pressure fuel pump 46 is disposed beside and adjacent to the vapor separator tank 45. With this configuration, the throttle body 32, the vapor separator tank 45, and the high-pressure fuel pump 46 can be arranged within a small space.

In this preferred embodiment, as described above, the vapor separator tank 45 is placed on one side across the center line "O" crossing the central axis of the air passage 32*a* of the throttle body 32, while the high-pressure fuel pump 46 is placed on the other side, so that the air passage 32*a* of the throttle body 32 is sandwiched between the vapor separator tank 45 and the high-pressure fuel pump 46. Thus, a unit constructed with the throttle body 32, the vapor separator tank 45, and the high-pressure fuel pump 46 can be made compact.

In this preferred embodiment, as described above, the pump main portion 46*a* is disposed below the throttle body 32 and disposed beside and adjacent to the vapor separator tank 45. Since the pump main portion 46*a* is disposed beside and adjacent to the vapor separator tank 45, the pipe 46*e* arranged to connect the pump main portion 46*a* and the vapor separator tank 45 can be prevented from being lengthened.

In this preferred embodiment, as described above, the bearing portion 32*k* is preferably integral with the throttle body 32 in the vicinity of the air passage 32*a* of the throttle body 32 to retain the rotary shaft 46*c* to be rotatable. Therefore, the rotary shaft 46*c* can be extended above the throttle body 32 via the bearing portion 32*k* located in the vicinity of the air passage 32*a* of the throttle body 32. Thus, the pump main portion 46*a* is disposed in the vicinity of the air passage 32*a* of the throttle body 32, which makes it possible to bring the pump main portion 46*a* close to the vapor separator tank 45. Therefore, the pipe 46*e* arranged to connect the pump main portion 46*a* and the vapor separator tank 45 can be further prevented from being lengthened.

In this preferred embodiment, as described above, the injector 47 is disposed adjacent to the throttle body 32 and configured to inject fuel in the throttle body 32. Thus, all of the vapor separator tank 45, the high-pressure fuel pump 46, and the injector 47 can be disposed in the vicinity of the throttle body 32. Since the fuel system 40 is thus disposed within a small space, the pipes 46*e*, 46*f*, 46*g* arranged to connect the vapor separator tank 45, the high-pressure fuel pump 46, and the injector 47 can be shortened. This decreases a heat-receiving area that receives heat radiated from the engine 20, thereby minimizing the generation of vapor (vaporized fuel). Since the fuel system 40 is disposed within a small space, the outboard motor 1 can be made compact.

In this preferred embodiment, as described above, fuel is injected in the throttle body 32. Thus, the single injector 47 can supply fuel-air mixture to the two cylinders 21.

In this preferred embodiment, the vapor separator tank 45, the high-pressure fuel pump 46, and the injector 47 are supported by the throttle body 32, and therefore the fuel system 40 including the vapor separator tank 45, the high-pressure fuel pump 46, and the injector 47 is not directly supported by the heated engine 20. Therefore, differing from the case where the fuel system 40 is supported by the engine 20 via supporting members, it is possible, in this preferred embodiment, to minimize an increase in the temperature of the fuel system 40 caused by heat directly transmitted from the engine 20 via the supporting members and the like.

In this preferred embodiment, the throttle body 32, the vapor separator tank 45, and the high-pressure fuel pump 46 are disposed adjacent to each other to be fixed together, thereby defining a unit. Therefore, the throttle body 32, the vapor separator tank 45, and the high-pressure fuel pump 46 are assembled as one unit and the assembled unit can be attached to the intake system 30. This improves the ease of assembling of the outboard motor 1.

It should be understood that the preferred embodiments disclosed herein are illustrative in all respects and not restrictive. The scope of the present invention is intended to be defined not by the above description of the preferred embodiments but by the claims, and to include all equivalents and modifications of the claims.

For example, in the above preferred embodiments, the vapor separator tank 45 is disposed below and adjacent to the throttle body 32. However, the present invention is not limited thereto. The vapor separator tank 45 may be disposed beside and adjacent to the throttle body 32.

In the above preferred embodiments, the vapor separator tank 45 and the throttle body 32 are preferably fixed by the screws 200, for example. However, the present invention is not limited thereto. The vapor separator tank 45 and the throttle body 32 may be integrally made of resin, for example.

In the above preferred embodiments, the vapor separator tank 45 and the outer frame 46*b* of the high-pressure fuel pump 46 are preferably fixed by the screws 201, for example. However, the present invention is not limited thereto. The vapor separator tank 45 and the outer frame 46*b* of the high-pressure fuel pump 46 may be integrally made of resin, for example.

Figure 14:
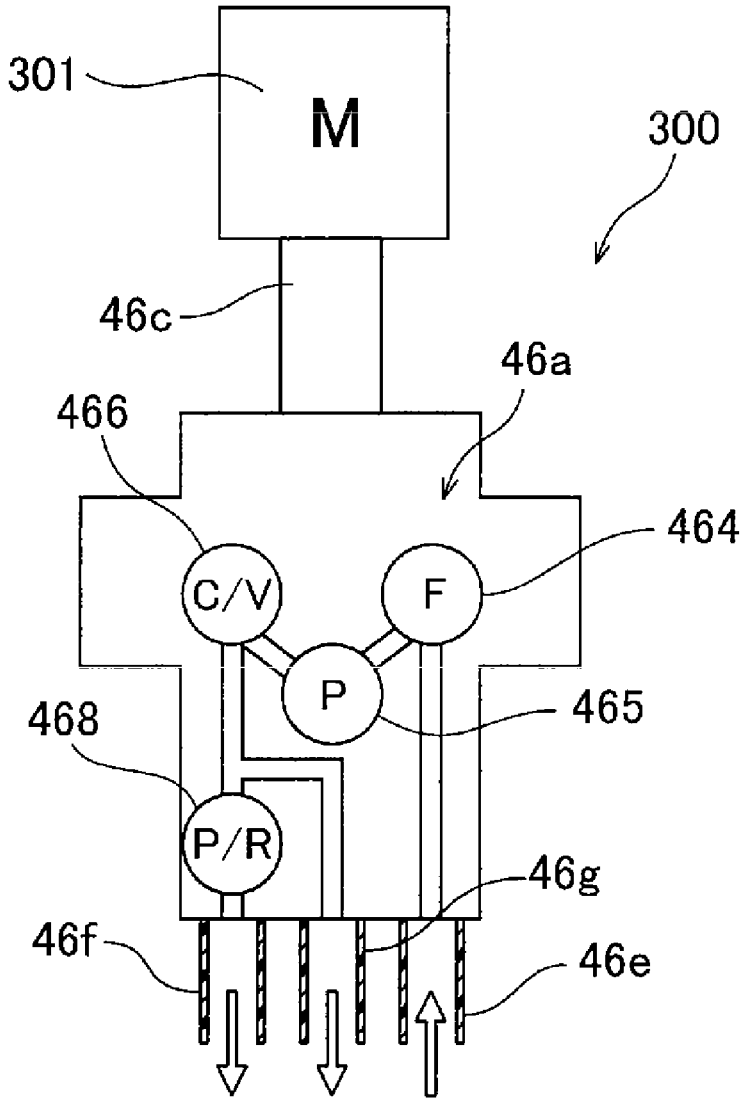
FIG. 14 is a schematic view showing a high-pressure fuel pump of an outboard motor according to a first variation of a preferred embodiment of the present invention.

In the above preferred embodiments, the pulley 46*d* fixed to the rotary shaft 46*c* of the high-pressure fuel pump 46 is preferably meshed with the belt 26 for driving the camshaft 27 to drive the high-pressure fuel pump 46 using the driving force of the engine 20. However, the present invention is not limited to this example. As in a high-pressure fuel pump 300 according to a first variation shown in FIG. 14, the high-pressure fuel pump 300 may be configured such that the rotary shaft 46*c* is rotated by the driving force of a motor 301 to drive the high-pressure fuel pump 300. Note that the motor 301 is an example of the "pump driving section" according to a preferred embodiment of the present invention.

In the above preferred embodiments, the rotary shaft 46*c* of the high-pressure fuel pump 46 is preferably rotated by the pulley 46*d* and the belt 26. However, the present invention is not limited thereto. The rotary shaft 46*c* may be rotated by transmitting rotation of the camshaft 27 to the rotary shaft 46*c* of the high-pressure fuel pump 46 using gears and the like.

In the above preferred embodiments, the high-pressure fuel pump 46 transports fuel by driving the plunger 463 with the swash plate 462. However, the present invention is not limited thereto. Other types of high-pressure fuel pumps such as a vane-type pump, a screw-type pump or a trochoid-type pump may be used.

In the above preferred embodiments, an in-line type fuel pump in which the high-pressure fuel pump 46 is disposed outside the vapor separator tank 45 is preferably used. However, the present invention is not limited thereto. The high-pressure fuel pump 46 may be disposed inside the vapor separator tank 45

In the above preferred embodiments, the fuel preferably is gasoline. However, the present invention is not limited thereto. The fuel may be alcohol.

In the above preferred embodiments, the fuel supply system for a boat of the present invention is preferably applied to the outboard motor 1. However, the present invention is not limited thereto. The fuel supply system may be applied to an inboard motor in which an engine section is mounted on a hull or to an inboard/outboard motor.

In the above preferred embodiments, the throttle body 32 is preferably configured to contact the vapor separator tank 45. However, the present invention is not limited thereto. A gap or another member may be provided between the throttle body 32 and the vapor separator tank 45.

In the above preferred embodiments, the high-pressure fuel pump 46 and the vapor separator tank 45 are preferably supported by the throttle body 32 of the intake system 30. However, the present invention is not limited thereto. The high-pressure fuel pump 46 and the vapor separator tank 45 may be supported by another component. For example, the high-pressure fuel pump 46 and the vapor separator tank 45 may be supported by such a component as a bracket fixed to the engine.

Figure 15:
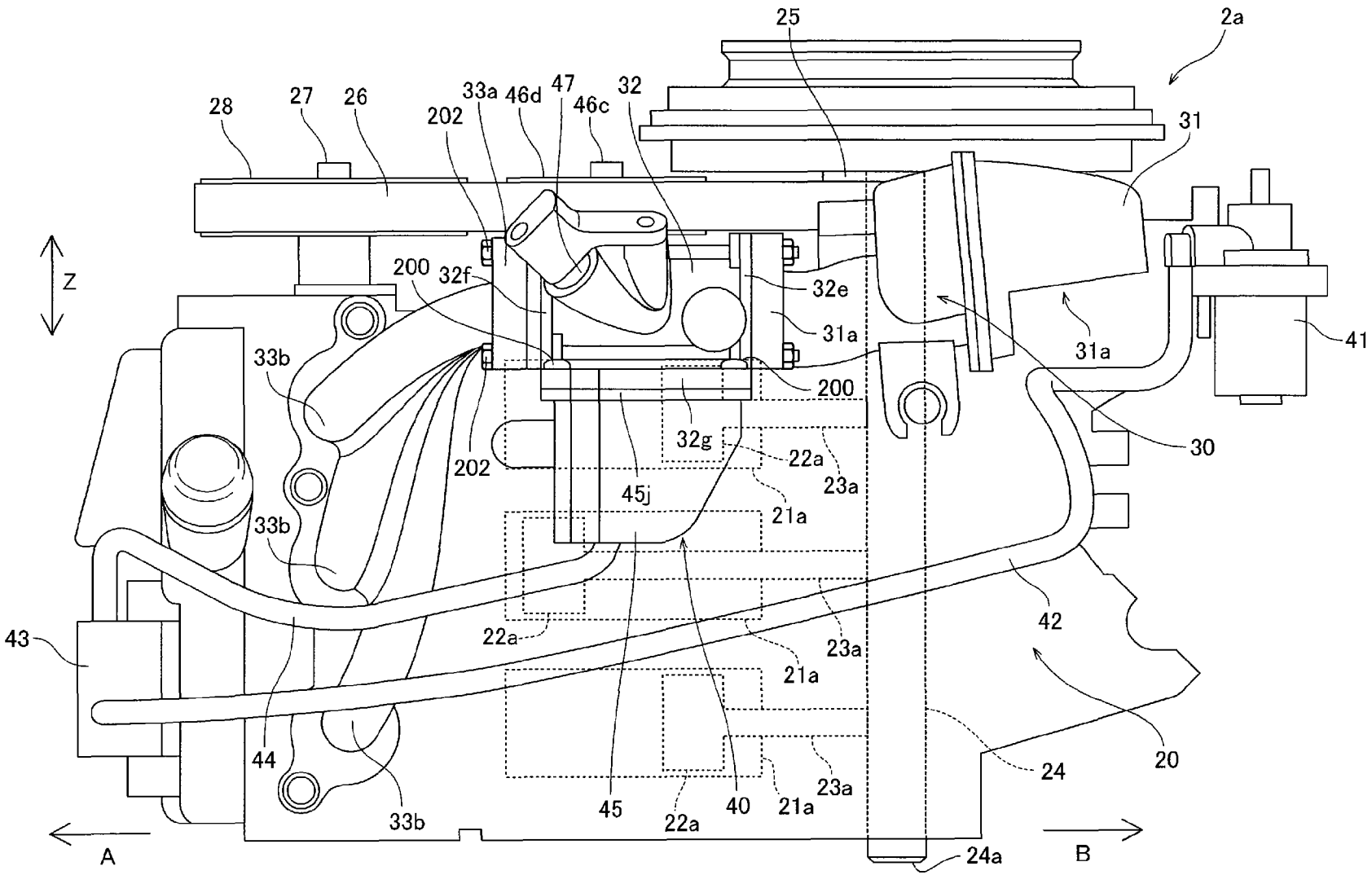
FIG. 15 is a side view of an engine section according to a second variation of a preferred embodiment of the present invention.
Figure 16:
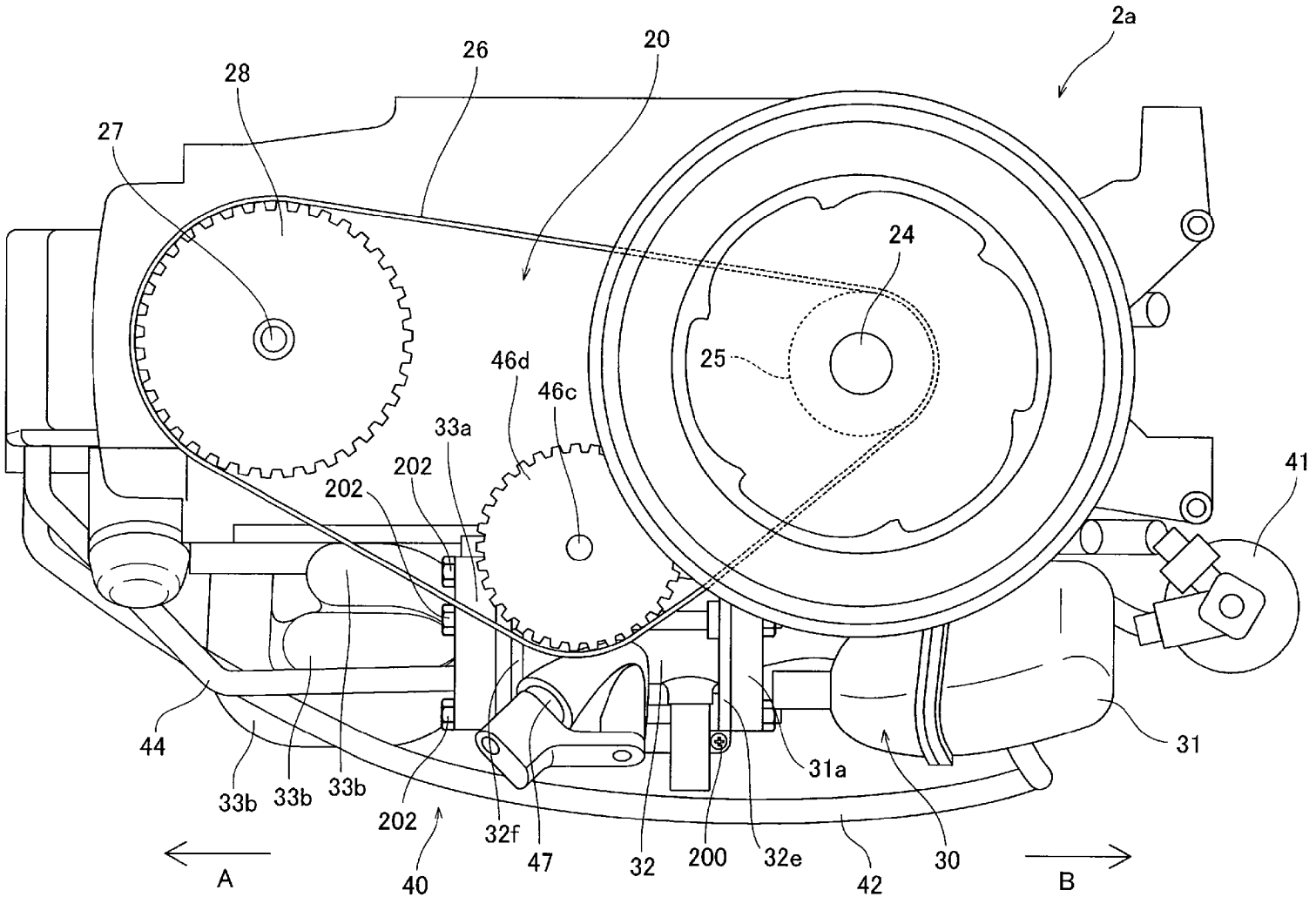
FIG. 16 is a plan view of the engine section according to the second variation of a preferred embodiment of the present invention.

In the above preferred embodiments, the present invention is applied to the outboard motor 1 preferably utilizing the two-cylinder engine section 2 having the two cylinders 21. However, the present invention is not limited thereto. The present invention may be applied to an outboard motor utilizing an engine section having one cylinder or three or more cylinders. For example, a three-cylinder engine section 2*a* according to a second variation shown in FIGS. 15 and 16 includes three cylinders 21*a* each having a piston 22*a* and a connecting rod 23*a*. The engine section 2*a* is connected to the throttle body 32 and includes three intake pipes 33*b* respectively connected to an intake port (not shown) of each of the three cylinders 21*a*. The construction other than the above mentioned is similar to that of the engine section 2 in the outboard motor 1.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A fuel supply system for a boat, the fuel supply system comprising:

a second fuel tank to receive fuel from a first fuel tank mounted on a hull of a boat, the second fuel tank to contain fuel therein;

a fuel injection device to supply fuel to an engine of the boat;

a fuel supply pump to supply the fuel contained in the second fuel tank to the fuel injection device; and a throttle body including a throttle valve to adjust a flow rate of air supplied to the engine; wherein the second fuel tank is directly mounted to a lower portion of the throttle body;

the fuel injection device is directly mounted to an upper portion of the throttle body; and the fuel supply pump is disposed below the throttle body and directly mounted to an outside of the second fuel tank.

2. The fuel supply system for a boat according to claim 1, wherein a flange of the second fuel tank and a flange of the throttle body are connected to each other by at least one screw.

3. The fuel supply system for a boat according to claim 1, wherein the second fuel tank and the fuel supply pump are spaced away from the engine.

4. The fuel supply system for a boat according to claim 1, further comprising:

a communication passage to connect the second fuel tank and the throttle body; and a check valve in the communication passage to allow vaporized fuel in the second fuel tank to pass in a direction from the second fuel tank to the throttle body.

5. The fuel supply system for a boat according to claim 2, wherein at least a portion of the fuel supply pump is disposed directly below the flange of the second fuel tank.

6. The fuel supply system for a boat according to claim 1, wherein the second fuel tank is placed on one side with respect to a vertical center line crossing a central axis of an air passage of the throttle body, and the fuel supply pump is placed on the other side with respect to the vertical center line.

7. The fuel supply system for a boat according to claim 1, wherein the fuel supply pump includes a pump main portion having a fuel path, a rotary shaft to drive the pump main portion, and a pump driving section to rotate the rotary shaft; and the pump main portion is disposed below the throttle body.

8. The fuel supply system for a boat according to claim 7, wherein the rotary shaft of the fuel supply pump extends upward from the pump main portion and is positioned out of the air passage of the throttle body as seen from the top, and a bearing portion is integral with the throttle body in the vicinity of the air passage to retain the rotary shaft to be rotatable.

9. The fuel supply system for a boat according to claim 1, wherein the fuel injection device is configured to inject fuel in the throttle body.

10. The fuel supply system for a boat according to claim 9, wherein the engine includes a plurality of cylinders and a plurality of intake pipes, first ends of which are connected to the throttle body and second ends of which are respectively connected to the plurality of cylinders, and the fuel injection device is provided for all of the plurality of intake pipes.

11. The fuel supply system for a boat according to claim 1, wherein the second fuel tank, the fuel injection device, and the fuel supply pump are supported by the throttle body.

12. The fuel supply system for a boat according to claim 1, wherein at least one of a throttle opening sensor to detect the opening degree of the throttle valve, an intake air temperature sensor to detect air temperature in the throttle body, an intake air pressure sensor to detect air pressure in the throttle body, and an Idle Speed Control unit is disposed adjacent to the throttle body.

13. An outboard motor comprising:

an engine including at least one cylinder;

a second fuel tank to receive fuel from a first fuel tank mounted on a hull of a boat, the second fuel tank to contain fuel therein;

a fuel injection device to supply fuel to the engine;

a fuel supply pump to supply the fuel contained in the second fuel tank to the fuel injection device; and a throttle body including a throttle valve to adjust a flow rate of air to the engine; wherein the second fuel tank is directly mounted to a lower portion of the throttle body;

the fuel injection device is directly mounted to an upper portion of the throttle body; and the fuel supply pump is disposed below the throttle body and directly mounted to an outside of the second fuel tank.

* * * * *